United States Patent [19]

Edelson

[11] Patent Number: 4,987,625

[45] Date of Patent: Jan. 29, 1991

[54] ADJUSTABLE PERSONAL SUPPORT APPARATUS

[76] Inventor: Nathan E. Edelson, 526 Hickory St., Missoula, Mont. 59801

[21] Appl. No.: 427,347

[22] Filed: Oct. 27, 1989

[51] Int. Cl.[5] ..... A47C 20/00

[52] U.S. Cl. ..... 5/431; 5/437; 5/465; 5/420

[58] Field of Search ..... 5/431, 434, 437, 445, 5/464, 465, 470, 420

[56] References Cited

U.S. PATENT DOCUMENTS

| | | | |
|---|---|---|---|
| 433,905 | 8/1890 | Muller | 5/465 |
| 1,537,414 | 5/1925 | Darling | 5/465 |
| 2,839,766 | 6/1958 | Hull | 5/431 |
| 3,736,023 | 5/1973 | Lyons | 5/465 |
| 4,484,781 | 11/1984 | Phelps | 297/DIG. 3 |
| 4,528,706 | 7/1985 | Banker | 5/431 |
| 4,635,306 | 1/1987 | Willey | 5/431 |
| 4,905,330 | 3/1990 | Jacobs | 5/431 |

FOREIGN PATENT DOCUMENTS

| | | | |
|---|---|---|---|
| 546541 | 4/1956 | Belgium | 5/437 |
| 1464661 | 9/1965 | France | 5/465 |
| 572723 | 2/1976 | Switzerland | 5/465 |

*Primary Examiner*—Gary L. Smith
*Assistant Examiner*—F. Saether
*Attorney, Agent, or Firm*—Hoffman, Wasson & Gitler

[57] ABSTRACT

A plurality of resilient cushions are flexibly attached in a collapsible unitary structure which may be easily adjusted to provide head and body support for persons working or resting in prone, supine and other bodily attitudes. A primary, wedge-shaped upper-body cushion is joined at its thick end by hinged means to a smaller parallelelpipedic head pillow which may pivot so as to lie either on top, or in front of, the inclined upper surface of the primary cushion. When in the later position it is supported on a parallelepipedic protrusion of the primary cushion. The upper front corners of the primary cushion are chamfered to provide arm support, and its truncated rear end is joined by hinged means to a parallelepipedic lower-body cushion, and also provided with a handle for ready transport and storage of the entire device.

8 Claims, 4 Drawing Sheets

(Bottom view)

ADJUSTABLE PERSONAL SUPPORT APPARATUS

BACKGROUND OF THE INVENTION

1. Field of the invention

This invention relates to furniture, specifically to convertible multi-purpose furniture comprising a plurality of attached cushions which may be folded for transport and storage.

2. Discussion of Prior Art

Many children and adults spend considerable time in prone, supine and intermediate positions watching TV, reading, writing, computing, playing games or musical instruments, exercising, resting, sunbathing, and the like. Heretofore, in order to meet the body support requirements of these positions, it has been customary to utilize a plurality of pillows and cushions, which, however, are cumbersome, unwieldy and of limited functional effectiveness. In the case of prone lying, persons also frequently resort to leaning on their forearms while raising and straightening their upper bodies to permit the pursuit of activities requiring frontal vision. This forearm-support method, however, requires considerable and fatiguing muscular effort, as it requires continuous isometric contraction of the triceps brachii muscles and also places prolonged hyperlordosic strain on the lower back, as well as concentrated and painful pressure on the elbows.

While various multiple-cushion foldable mats, mat-headrest combinations and other mattress and lounging devices have been taught in prior art to effect multi-positional body support, none provide adequately for both prone and supine lying, and various other static and dynamic positioning requirements, particularly with respect to support of the head. U.S. Pat. No. 3,003,815 to Zinn, discloses an article of bulky proportions which appears to offer negligible comfort when used in the prone position, since it places undue pressure on the laryngeal prominence of the neck. The device is also predicated on dubious assumptions about the resilience and durability of fabric-covered polyurethane foam subjected to unusual stresses over time. U.S. Pat. No. 4,171,549 to Morrell and Gray appears to provide a desirable degree of positioning flexibility, and bears a slight visual resemblance to my invention, however, this device is intended solely for supine lying, and being of non-attached parts and "bean-bag" construction, would be awkward to transport and would require frequent refilling with bean pellets to maintain adequate resiliency, both of which factors severely limit its utility.

U.S. Pat. No. 2,589,013 to Martin describes a three-piece attached cushion system intended for use when sitting upright in an automobile, particularly when watching a drive-in movie. Although generically similar to my invention, it lacks an independent support for its uppermost flexibly-hinged pillow, which makes it ill-suited for prone and supine lying.

U.S. Pat. No. 4,518,203 to White is representative of a variety of multi-cushion adjustable lounging devices which are comparatively bulky, relatively difficult to adjust, and which do not provide for prone lying with the lower back supported in a desirable attitude of moderate extension.

U.S. Pat. No. 4,411,221 to Enste teaches a "Child Support Wedge" with multi-positioning modalities, but this device is large, cumbersome, expensive to manufacture, and lacking a head-support feature when used in the prone position. It is designed primarily for severely handicapped individuals.

Apart from the above referenced and other still less apposite patented devices, there are several apparently unpatented therapeutic multi-positional wedges and cushions currently under manufacture; those bearing the closest resemblance to my invention are probably the "OB Mat," the "Grasshopper," the "Thera-Wedge," and various "Wedges," all made by the Tumble Forms Division of Preston Corporation of Clifton, N.J. These are all high-quality products, however, being intended for specialized medical use, they suffer from a number of deficiencies when considered against the objects of my invention. For example, they lack adequate head support, are of oppressively firm density for extended use, are coated with a tactually unappealing material, exude an unpleasant odor, and are heavy, bulky and relatively expensive. Finally, there is an apparently unpatented article called the "Frontal," formerly offered for sale by Westnofa USA Inc., of Niles, Ill., which reputedly combined a wedge-shaped upper body cushion with a facial mask containing eye and nose openings, thereby permitting prone lying while reading. This product, however, has been discontinued and its manufacturers will disclose no further information on its construction. It would appear to have offered no head support for supine lying, an important object of my invention, and suffered other deficiencies which prevented it from finding commercial success.

While the above survey of patents and products is not exhaustive, it does cover to my best knowledge that prior art which bears closest resemblance in appearance and proposed function to the objects of my invention, which are to provide a unitary multi-positional support device that:

(1) May be comfortably used in both prone and supine positions, and which, through a simple adjustment, will also provide head support under both conditions.

(2) Enables a user to be supported in a variety of positions other than prone or supine lying, including but not limited to cross-legged or other kinds of sitting, kneeling, and lying on the side.

(3) Is light and compact, and so may be easily transported and stored, further adding to its convenience and utility.

(4) Obviates the need for a plurality of conventional room furniture, thereby freeing up valuable space and encouraging healthy physical movement.

(5) May benefit persons suffering from respiratory, cardiac or other medical conditions who need to sleep, read, watch TV, or conduct other activities in bed or elsewhere in a raised or semi-reclining supine position.

(6) May aid in preventing or relieving lower back pain by permitting back sufferers to lie prone in a position of moderate hyperlordosic extension, and also enable them to more readily perform certain remedial therapeutic exercises such as supine straight leg raises, knee-to-chest flexion pulls, etc.

(7) Is of a durable and aesthetically pleasing design which may find ergonomic utility in physical therapy, massage, and sexual intercourse.

(8) Can be used by young children for gymnastic activities such as running, jumping, climbing and tumbling, and also in lieu of conventional single-purpose rest mats.

(9) Provides comfort and support for persons who desire to sunbathe, read, rest, discharge a firearm, or otherwise enjoy the outdoors, or who require flexible positioning support within cars, vans, campers, trains, airplanes, boats or busses.

(10) May serve as an easily cleanable bed for pets such as dogs and cats.

(11) Is economical to manufacture and hence may be readily acquired by all who can benefit from its use.

Other objects and advantages of my invention will become apparent form a consideration of the ensuing description and drawings.

DESCRIPTION OF THE PREFERRED EMBODIMENT

Figure 1:
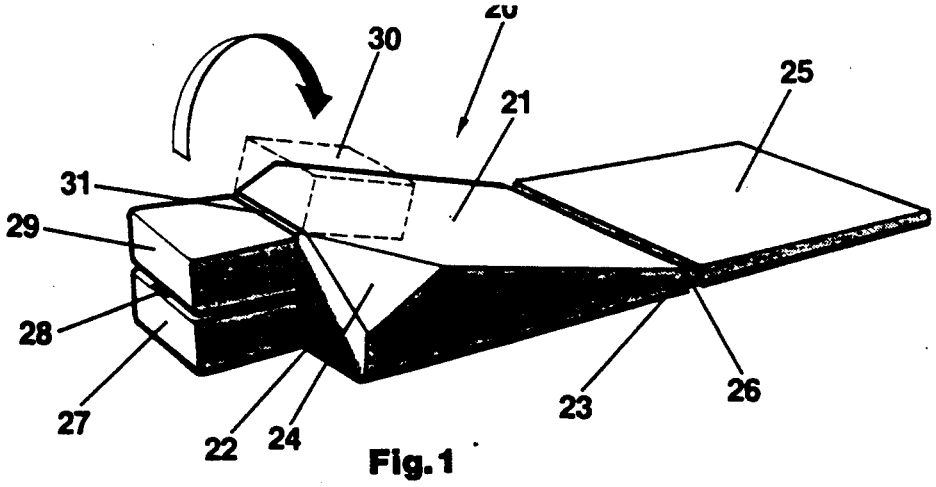
FIG. 1 is a general view of the invention when it is open and ready for use by a person lying in a prone attitude, with the hinged pillow shown as broken lines as it would be adjusted for use by a person lying in a supine attitude.

Referring now to FIG. 1, there is shown a typical embodiment of my multi-positioning support device 20 comprising a substantially wedge-shaped upper body cushion 21, with a protrusion at its thick end 27, located beneath a hinged pillow 29. The pillow is flexibly attached to the top edge of the end panel 22 of the upper body cushion 21 by a hinged flap 31. The upper-body cushion 21 is provided with symmetrically chamfered corners 24 on its thick end, which provide for ergonomic arm support when the device is used by a person in the prone position. A substantially parallelepipedic lower-body cushion 25 is flexibly attached to the truncated thin end 23 of the upper-body cushion 21 by means of a hinged flap 26. The thickness of the lower-body cushion 25 is substantially the same as that of the truncated end 23 of the upper-body cushion, which provides for a smooth transition for body parts in contact with these cushions. Alternatively, the invention might not include a lower-body cushion, which could be eliminated for reasons of economy without adversely affecting the structure or operation of the remainder of the device.

Figure 2:
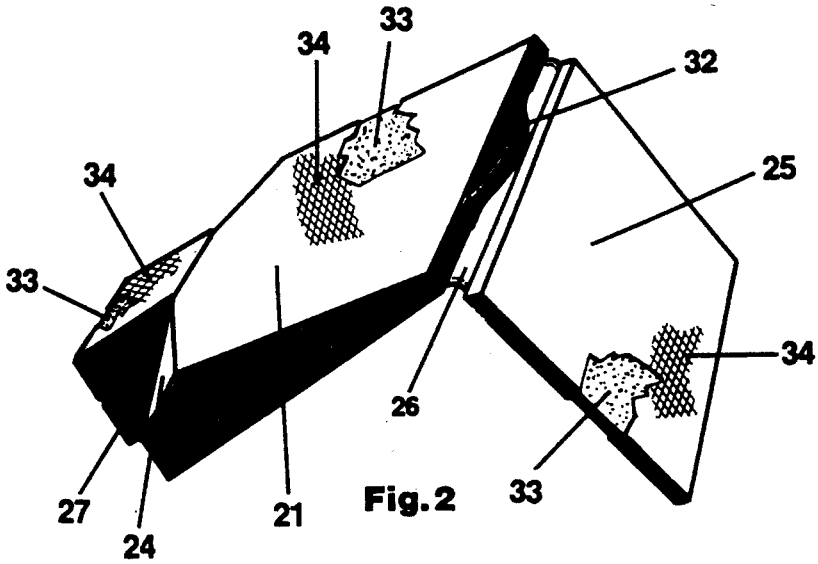
FIG. 2 is a top end view of the invention in a partially folded position.

The inner core 33 of the upper-body cushion 21, and also all other parts of the device, shown in FIG. 2, are made preferably of urethane foam. However, other materials may be substituted, provided they are of sufficient compressibility to comfortably support the human body, and are of sufficient resiliency to return to their original shapes after use. If foamed plastics are used, the device may be foamed in place, or may be cut into the desired shape from bulk or slab stock, as is here illustrated, and then covered with durable fabric 34, such as Cordura Plus Brand Nylon. Cordura Plus is a trademark of E.I. duPont deNemours & Co., Wilmington, Del. Vacuum forming or molding techniques may also be employed to produce the cores, and these may subsequently be coated with sprayed vinyl or other plastics, in addition to, or in lieu of, a fabric slipcovering, for protective or decorative purposes. It is within the scope of this invention that the urethane foam or other core materials used within the several parts of the device be of differing densities and degrees of resilience, so as to provide optimum comfort for the various body parts which they will support. For example, the density of the urethane foam in the upper-body support cushion 21 is about 40 lbs per cubic foot, whereas in all other sections the density is about 70 lbs per cubic foot.

The carrying handle 32 is attached to the truncated thin end 23 of the upper-body cushion 21. This handle is preferably made of nylon or polypropylene webbing or elasticized belting material, sewn at both ends to the durable fabric covering 34, and is of such length that it may be easily gripped by the hand yet can also be tucked completely within a trough defined between the upper-body and lower-body cushions 21 and 25, for neatness of appearance when the device is in a fully open position.

Figure 4:
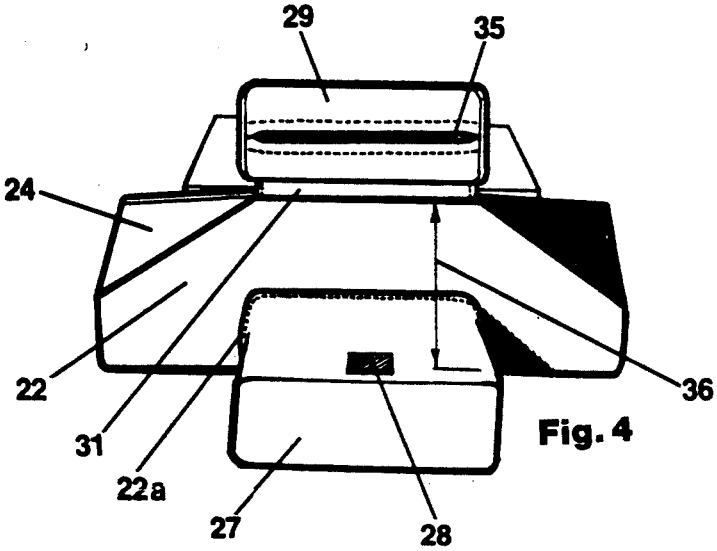
FIG. 4 is a front end view showing the hinged pillow folded up and back in the supine-lying position.
Figure 3:
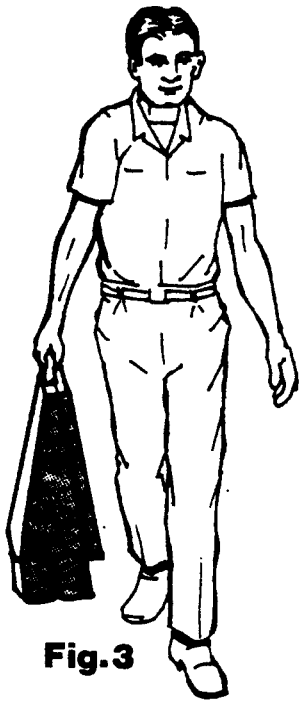
FIG. 3 shows a person carrying the invention in its fully folded position.

FIG. 3 depicts a person using the handle to carry the multi-positional support device in its completely folded position. Referring to FIGS. 1 and 4, a patch 28 of hook-and-loop fastener material such as Velcro ("Velcro" is a trademark of the Velcro Corporation, Manchester, N.H.) keeps the pillow 29 from flapping about while being transported: note that only the "hook" portion of the Velcro is used, with the fabric itself providing the "loop" action, thereby obviating the need for attaching a separate "loop" patch, which would tend to collect hair and lint.

Referring to FIG. 4, the multi-positional support device 20 is seen head-on from the thick end 22 of the upper-body cushion 21, with the hinged pillow 29 flipped up and back, as it would be when the device was being used for supine lying. In a preferred embodiment, the protrusion 27 is a fabric pocket sewn directly to the lower central portion of the fabric end-panel 22 of the thick end of the upper-body cushion 21. The end-panel fabric material lying within the sewn joint 22*a* is cut away so that a foam core may be inserted through the upper-body cushion zipper opening 40 in FIG. 5, and fitted into this pocket. The foam core of pillow 29 is inserted through zippered opening 35 on the hinged fabric end-panel of that part.

Note from FIG. 4 that the height of the hinged pillow 29 and the height of the pillow-support protrusion 27 are approximately equal, and that together they comprise the approximate height 36 of the thick end 22 of the upper-body cushion 21. These proportions are not arbitrary; if the hinged pillow had a height considerably greater than that of the pillow-support protrusion, a person's head would be lifted to a more-than-desirable angle when the pillow 29 was used in a supine attitude; whereas if the hinged pillow had a height considerably less than that of the pillow-support protrusion, a person's head would not be raised sufficiently for comfort in that same attitude, and strain would be placed by way of compensation on the sternocledomastoid muscles of the neck. Of course, the hinged pillow 29 must also be able to bear directly upon the pillow-support protrusion 27, so that the weight of the head may be transferred to the ground or other support surface when the multi-positional support device 20 is used by a person in a prone-lying attitude.

Figure 5:
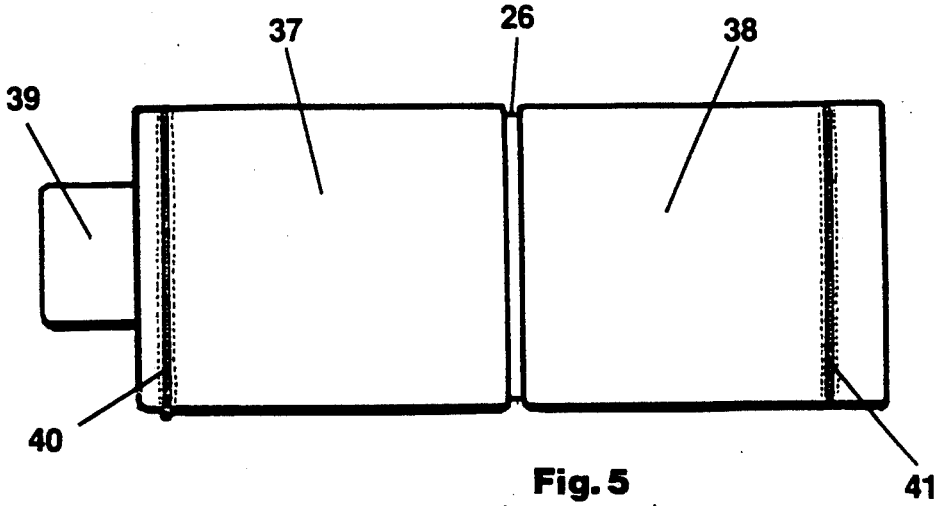
FIG. 5 is a plan view of the bottom of the invention in a fully open position.

FIG. 5 shows the bottom of the multi-positional support device in an opened position. The length and width of the bottom of the upper-body cushion 21, and that of the lower-body cushion 25, are approximately the same, which permits the latter to be neatly folded back upon the former for ready transport of the entire device. The zipper flaps 40 and 41 provide for the insertion of foam core elements into the upper-body and lower-body cushions 21 and 25, respectively. The lower-body cushion hinge 26 is shown in a fully extended position. This hinge, as well as the hinge 31 in FIGS. 1 and 4 securing the pillow 29 to the upper-body cushion, may be constructed of a durable fabric 34 similar to that used in covering the rest of the multi-positional support device, provided that it is doubled-over to make a two-sided durable continuous pivot. If the entire device is of vacuum formed or molded construction, these hinges may be integrally vacuum formed or molded, or else they may be made of some other strong yet flexible material such as polypropylene or nylon webbing, which is connected to the several sections during or after forming. Both pillow hinge 31 and lower-body cushion hinge 26 may also take the form of flexible zippered connections whereby the pillow 29 and lower-body cushion 25 may be easily removed for cleaning or replacement.

Figure 9:
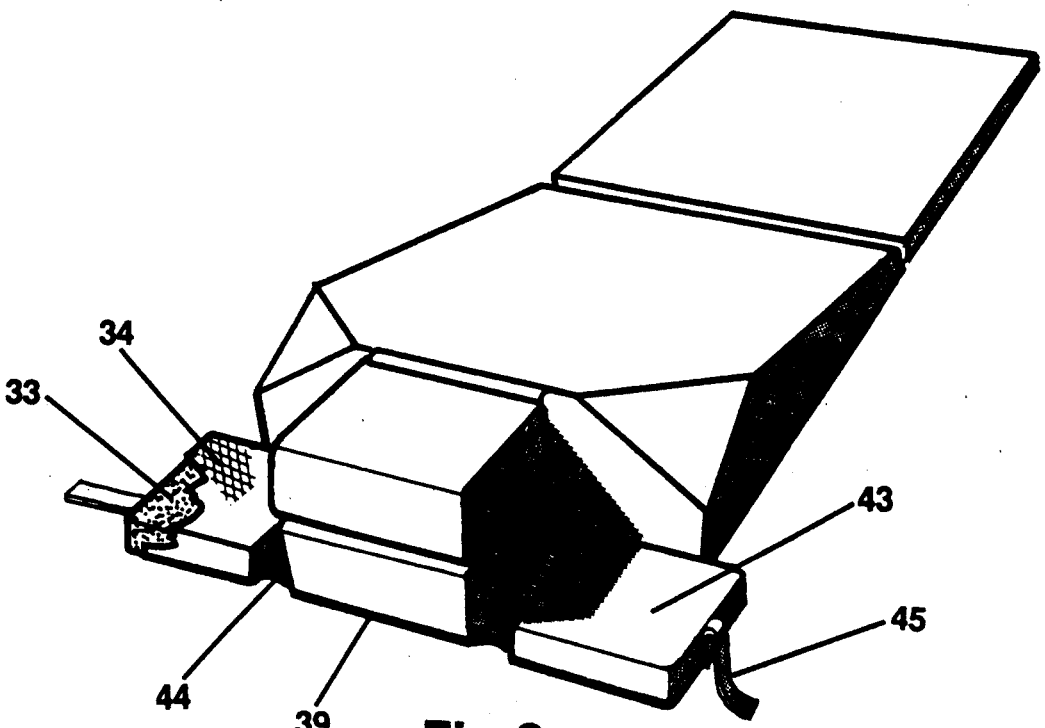
FIG. 9 is general view of an alternate embodiment of the invention incorporating elbow support flaps, which are shown in their open and ready-for-use position.
Figure 10:
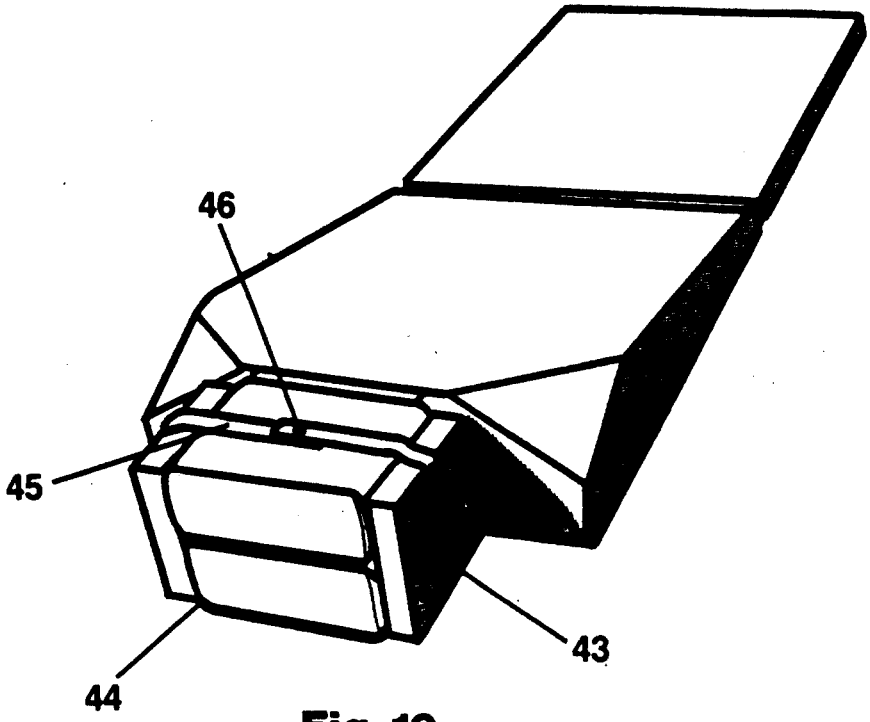
FIG. 10 shows the elbow support flaps in a closed and fastened position, in preparation for transport

An alternative embodiment of my invention is shown in FIGS. 9 and 10, including symmetrical right-parallelepiped elbow support cushions 43 flexibly attached via fabric or other hinge means 44 to the bottom 39 of the pillow-support protrusion. In the preferred embodiment, the elbow-support cushions 43 contain a core of open-cell urethane foam of about the same density and thickness as that of the lower-body cushion 25, and are covered with a durable fabric 34 similar to that used on the rest of the device. The cushions 43 may, however, be constructed of vacuum formed or molded open-cell foams, or of closed cell flexible plastic foams such as Ensolite. ("Ensolite" is a trademark of Uniroyal Corp., of Middlebury, Conn.) In the latter case, the relative thickness of the elbow supports may be reduced, owing to the greater density and resilience of closed cell foam.

FIG. 9 shows the elbow-support cushions 43 in their open position, as when on is using the invention in a prone attitude on an otherwise hard surface, such as a wood floor. The length of each of the elbow-support cushions 43 is about the same as that of the height of the end-panel 22 (in FIG. 4) of the upper-body cushion; however, they may be made longer if desired through the addition of one or more flexibly hinged segments. The width of the elbow-support cushions is about the same as that of the pillow-support potrusion. In FIG. 10, the elbow-support cushions 43 have been raised to their upended closed position, from which it may be seen that the width of the exposed part of the flexible fabric hinges 44 is about the same as that of the thickness of the elbow-support cushions, making for a tight and neat fit when the cushions are upended and fastened together with a snap buckle 46 or other fastener secured to the ends of their binding straps 45, which may be of elasticized rubber or other material. In this position the entire device may be easily transported as in FIG. 3. While in a preferred embodiment, the elbow-support cushions are permanently attached to the underside of the pillow-support protrusion, they could be non-permanently attached by such means as snap closures, zippers, Velcro, or the like, if so desired for greater flexibility of use.

Figure 11:
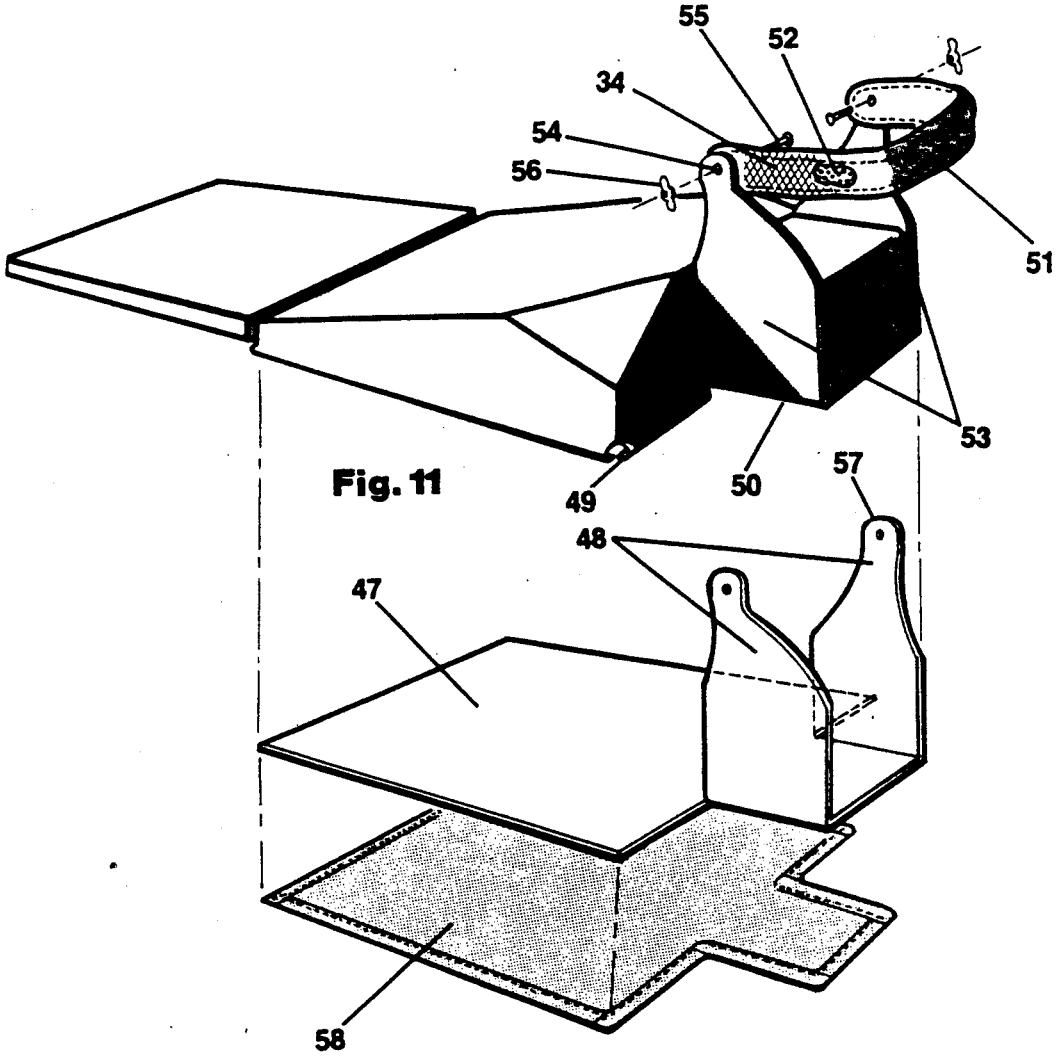
FIG. 11 is an exploded general view of a second alternate embodiment of the invention incorporating an integral forehead-support feature.

FIG. 11 illustrates a second alternative embodiment of the invention, incorporating an integral forehead-support band 51 which reduces the weight of the head on the temporomandibular joint connecting the skull with the jawbone when the device is used for relatively long periods by a person in the prone position with the chin supported on the pillow. This embodiment comprises a dimensionally stable thin base plate 47, molded or formed from high-strength plastic, and adhesively bonded to the bottom of the foam core of the upper-body cushion 21 and pillow-support protrusion 27. This base plate turns upwards at right angles into two symmetrical vertical arms 53 along the two parallel edges where the plate is contiguous with the two parallel lateral bottom exposed edges of the pillow-support protrusion 27. Each arm 53 extends upward approximately the height of the pillow 36, and then flairs outward, while undergoing a reduction in width, to rounded tips 57 having a hole 54 punched therethrough. The forehead support band 51, made of a reinforced resilient material such as closed cell flexible foam 52 covered with a durable fabric 34, is connected at either end to one of the arm tips 57 by means of a bolt 55 and thumbscrew 56. The fabric covering the upper-body cushion and pillow-support protrusion is drawn taught, wrapped under 49 and neatly fastened to the underside of base plate 47 by fabric cement, Velcro strips, or other means. A backing of edge-seamed low-pile carpeting or other suitable material is then glued or otherwise adhered to the bottom of the plate 47.

Means by which the height of the forehead-support band can be raised or lowered to more precisely configure the band to the anatomy of individual persons, and means by which the length of the forehead-support band can be made longer or shorter for the same purpose, may be provided if desired. Variations of the construction of the base plate are possible; for example, the plate can be made of more than one element, as when it is constructed of pieces of joined plywood. In that case, the pillow-support protrusion may assume the form of a foam-and-fabric-covered plywood or other rigidly constructed box, which provides cross-sectional bracing for the vertical arms holding the forehead-support band.

The exact dimensions of the components of my multi-positional support device have not been indicated in the drawings, since a range of sizes are appropriate for users of different sizes and genders. Representative critical dimensions in inches for a typical 7 year old child, and for an average adult are, respectively, length of bottom and upper-body cushion, 29, 21; width of same, 25, 30; height of thick end of same, 5, 8; height of truncated thin end of same, 1, 1; length of pillow, 6, 8; and width of pillow, 4½, 6.

In now considering the operational features of my invention, FIG. 3 shows a person carrying the device in its completely folded position by handle 32 attached to the truncated thin end 23 of the upper-body cushion 21. While the device is being carried, the pillow does not flap about but rather remains contiguous to the pillow-support protrusion, by virtue of the Velcro hook tab 28 which holds it in place. When the multi-position support device is in this folded position it may be stored behind or beside a sofa in a living room or den, in which case it would occupy a minimum of space and yet be readily accessible to one who might wish to place it on the floor when watching TV, reading, computing, exercising, and the like. The device may also be hung by the handle 32 from a peg or hook on the wall, making for especially quick and convenient access, as well as providing a decorative room feature, especially in the case of young children's rooms and preschool or elementary school settings.

When a person wishes to use my multi-positional support device, he or she would, while still holding the handle 32 with one hand, with the other hand extend the upper-body cushion outward and away from the lower-body cushion in the manner shown in FIG. 2, and then release the device in proximity to the floor or other support surface, whereupon it will assume the open configuration depicted in FIG. 1.

Figure 6:
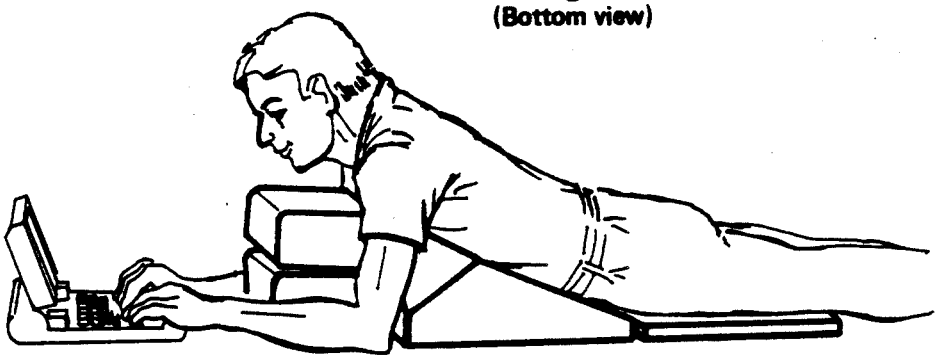
FIG. 6 shows a person using the invention in a prone attitude with head raised above the hinged pillow.
Figure 7:
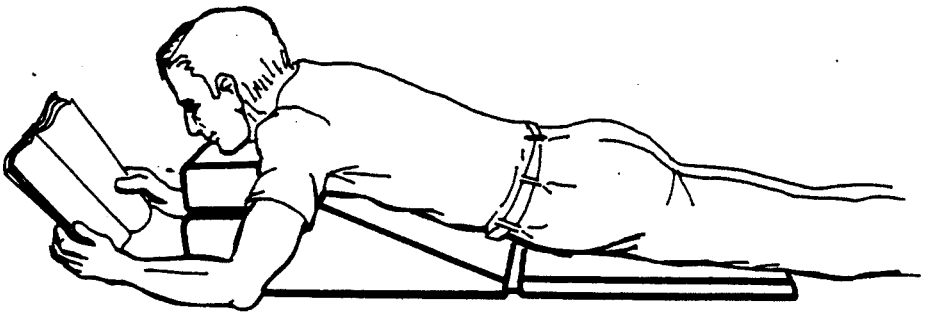
FIG. 7 shows a person using the invention in a prone attitude with the head supported on the hinged pillow.

FIGS. 6 and 7 show the invention being used in the chest-down or prone attitude. In FIG. 6, the user is operating a laptop computer while resting his lower body on the flat lower-body cushion and resting his upper body on the inclined upper-body cushion, while his arms are supported on the chamfered forward corners of the later cushion. The user's neck and head are held substantially in line with the rest of his spine a short distance above the pillow 29 which remains in a retracted position. FIG. 7 shows a person reading a book in a similar prone attitude as the user in FIG. 6; however, in this instance, he is supporting his chin directly on the pillow 29. In practice, one may choose to alternate between the head-up and head-down positions depicted in FIGS. 6 and 7 when engaged in prone-attitude activities, or may use the invention as a rest couch by simply turning the head to one side and placing the opposite cheek on the pillow. It may also be used in this manner to receive a back, shoulder and neck message by a second party.

It will be observed that regardless of the specific manner in which the multi-position support device is used by a person in the prone attitude, the person's lumbar spine is maintained in an attitude of mild to moderate extension, or backward-bending, which is generally recommended by physical therapists as a desirable exercise to counteract the debilitating effects of prolonged flexion, or forward-bending, which modern civilization imposes on persons during the bulk of their daily sedentary activities such as driving and sitting at a desk. Were one to attempt to assume similar prone attitudes to those depicted in FIG. 6 and 7 without my invention, it would be necessary for him either to support the entire weight of his upper body on his elbows and forearms, and suffer discomfort and fatigue due to the concentration of pressure and prolonged muscular effort induced thereby, or else to resort to constructing, with loose cushions, some temporary support means. Such a makeshift support, however, would almost certainly prove wanting, due to the inappropriate size, density, resilience and covering of the loose cushions employed. Moreover, these various loose cushions would either have to be removed from a sofa or chair, creating the appearance of havoc in the room, or else be specially purchased even though they failed to provide the utility which their buyer actually sought.

Figure 8:
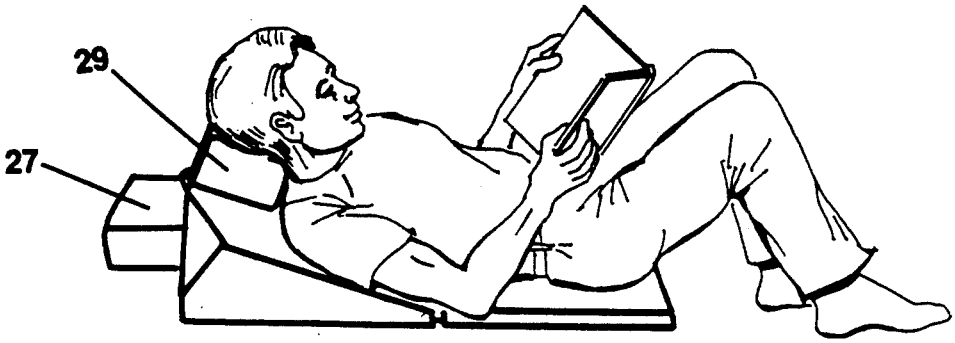
FIG. 8 shows an individual using the invention in a supine attitude, with the back of his head resting on the hinged pillow which has been folded up and back.

FIG. 8 shows a person reading a magazine while using the multi-positional support device in a supine, or chest-up attitude. It will be noted that the pillow is now in its flipped-up-and-over position, as may be further understood by returning to FIG. 1 and comparing the orientation of the pillow depicted by solid lines 29 and by broken lines 30. More particularly, the former top surface of the pillow, which received the chin or check of the user in a prone attitude, is now the bottom surface, which bears upon the uppermost portion of the top surface of the upper-body cushion; and the former bottom surface of the pillow, which was in contact with the pillow-support protrusion, is now the top surface, whereupon the back of the head is supported when the user adopts a supine attitude. It is a noteworthy feature of my invention that the transformation which permits the same attached pillow to be used for both prone and supine head support is quick and easy to achieve; specifically, the user need only lift the pillow from its normal position and drop it over into its alternative position for the change to be completed. No other multi-positional support device in the prior art offers such flexibility, convenience and utility.

In the embodiment of FIG. 9, elbow-support cushions have been provided to eliminate any discomforting pressure on the elbows when the multi positional support device is placed on a hard surface such as a wood floor and used in a prone attitude for a purpose such as typing on a laptop computer.

FIG. 10 shows the elbow-support cushions upended and secured about the pillow-support protrusion and pillow, so that they present no encumbrance to transport, and the entire device may be carried as in FIG. 3. Assuming that the user wishes to set up the elbow-support cushion embodiment of my invention, she would proceed in exactly the same manner as described above for setting up the device for prone lying, and then simply undo the snap 46 or other fastening means on the ends of the elbow-support cushion straps 45, whereupon the elbow-support cushions 43 would drop down into their correct positions, being restrained from excessive outward displacement or improper orientation by their attached fabric hinges 44. Of course, this procedure may be reversed when the user wishes to fold the elbow-support cushions up for transport or storage of the device as a whole.

Figure 12:
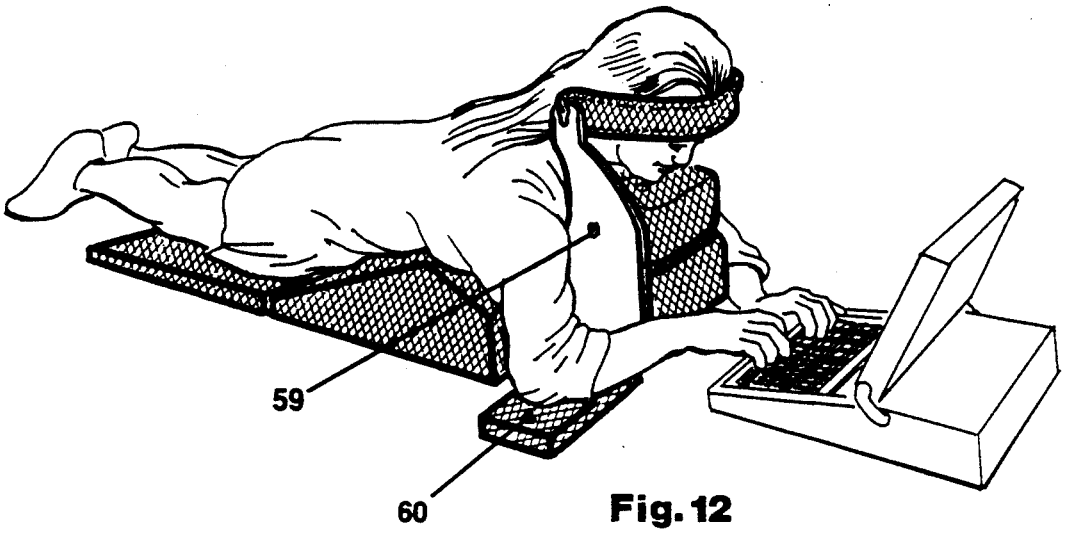
FIG. 12 shows an individual using a version of the invention incorporating the elbow support flaps and forehead support feature.

FIG. 12 illustrates a person operating a laptop computer utilizing the elbow-support cushions described above, and also employing a forehead-support, whose particulars are detailed in FIG. 11.

From the previous description of the construction of this embodiment of my invention, it will be appreciated that the forehead-support forms an integral feature of the invention and therefore requires no further assembly to be operational. Indeed, this embodiment of my invention may be transported in precisely the same manner as that illustrated in FIG. 3. Neither does this embodiment in any way limit the operation of the hinged pillow, although a slight change in the manner of opening and closing the optional elbow-support cushions is required, in that, rather than their being secured by straps which fasten over the pillow as in FIG. 10, each cushion has a male snap 59 attached thereto, which mates with a female snap 60 on the vertical arms of the headrest base plate.

With respect to the use of the forehead-support itself, the user need only place her chin on the pillow and place her forehead against the forehead-support band until finding a satisfactory frontal angle whereby she may readily see the computer screen or other work project, while displacing about one-third of the weight of her head on her chin, and two-thirds of the weight of her head on the forehead-support band. In practice the assumption of this attitude requires no special skill or effort since it precisely conforms to the requirements of comfort.

Regarding the justification for a forehead-support band at all, when it may be supposed that the pillow 29 alone might provide adequate support of the head when the chin is rested on it as in FIG. 7, the issue is one of duration of use; that is, for shorter periods, direct support of the head by the chin on the pillow is satisfactory. For longer periods, however, the weight of the head as it bears on the temporomandibular joint may create discomfort for some persons, and this may be relieved through displacement of the greater part of the weight of the head onto the forehead-support band.

Having now covered the operational procedure for the use of various embodiments of my invention, it remains to describe how it may be folded up for transport and storage. The method is so quick and easy that it constitutes a significant improvement over all prior art, for all a person must do is grab and lift the handle 32 of the multi-positional support device and it will immediately assume the portable closed position illustrated in FIG. 3 without any further adjustment. Of course, if the elbow-cushion embodiment of my invention is used, the cushions must first be secured in the manner described above, but this is a trivial operation requiring only seconds to perform. Returning now to a more general consideration of my invention, while FIGS. 6, 7 and 8 show some of the beneficial uses to which several of its embodiments may be employed, they by no means exhaust all of its purposes, a considerable number of which have previously been recited as objects of the device.

Although I have now illustrated and described several practical and representative embodiments of my invention, it should be understood that many additions, deletions, modifications, and variations are possible without departing from the spirit and scope of the present invention as defined in the claims which follow.

I claim:

1. An adjustable personal support apparatus comprising:

a substantially wedge-shaped upper-body support having a fixed protrusion at its thick end, said fixed protrusion having a base common with the base of said upper-body support, and a height less than that of thick end of said upper-body support;

said protrusion further having a width of about one-quarter to one-half of a side-to-side dimension of said thick end of said upper body support, and centered with respect thereto, and a substantially parallelepipedic head support having a length and width approximately equal to that of said fixed protrusion, and a height approximately equal to that of the difference between the height of said thick end of said upper-body support and the height of said fixed protrusion, said head support being flexibility connected along its inwardly facing top edge to the top edge of said thick end of said upper-body support at a position substantially above said protrusion, whereby said adjustable personal support apparatus may be comfortably used by persons in prone and supine positions for diverse activities.

2. The article of claim 1, wherein the wedge-shaped upper-body support has two symmetrical triangular chamfered top corners at its thick end, said triangular chamfered top corners are each defined by three points.

3. An adjustable personal support apparatus comprising:

a substantially wedge-shaped upper-body support having sides and a protrusion at its thick end, said protrusion having a height less than the height of said thick end, and means for supporting the head, said means being flexibly connected to said thick end of said upper-body support whereby said head support may rest upon said protrusion to prevent substantial deformation of said head supporting means when weight is applied thereto; and elbow-support means flexibly attached to the bottom of said upper-body support protrusion and are positioned at least partially between the sides of said wedge-shaped upper-body support whereby persons may more comfortably operate laptop computers and the like.

4. The article of claim 3, wherein said elbow-support means are approximately parallelepipedic fabric-covered foam cushions of nominal thickness with fastening straps attached to their distal ends.

5. The article of claim 4, wherein said fastening straps are equipped at their non-attached ends with reusable closure means such as snap buckles or Velcro strips, whereby said elbow-support means may be drawn up in a vertical position and secured for transport.

6. An adjustable personal support apparatus comprising a substantially wedge-shaped upper-body support having a protrusion at its thick end, said protrusion having a height less than the height of said thick end, said upper-body support having a base which is adhered to a dimensionally stable thin sheet of material substantially conforming to the shape of said base; said sheet of material rising upwards at approximately right angles in two symmetrical appendages along the two edges where said sheet is contiguous to the lateral bottom edges of said upper-body support protrusion, until reaching the approximate height of the thick end of said upper-body support; thence flaring outward and upward to symmetrical rounded tips by which they are connected to a forehead support means, and means for supporting the head, said means being flexibly connected to said thick end of said upper-body support whereby said head support may rest upon said protrusion to prevent substantial deformation of said head supporting means when weight is applied thereto.

7. The article of claim 6, wherein said thin sheet of material is molded high-strength plastic.

8. The article of claim 6, wherein said forehead-support means is a reinforced fabric-covered plastic foam strip.

* * * * *